US010316540B2

(12) United States Patent
Zhao et al.

(10) Patent No.: US 10,316,540 B2
(45) Date of Patent: Jun. 11, 2019

(54) TOWER LIFTING DEVICE FOR ROTARY BLASTHOLE DRILL

(71) Applicant: ATLAS COPCO (NANJING) CONSTRUCTION AND MINING EQUIPMENT LTD., Jiangsu (CN)

(72) Inventors: Jie Zhao, Jiangsu (CN); Ning Heng, Jiangsu (CN); Chengyun Zhu, Jiangsu (CN)

(73) Assignee: EPIROC (NANJING) CONSTRUCTION AND MINING EQUIPMENT CO., LTD., Jiangsu (CN)

( * ) Notice: Subject to any disclaimer, the term of this patent is extended or adjusted under 35 U.S.C. 154(b) by 331 days.

(21) Appl. No.: 15/504,805

(22) PCT Filed: Jul. 31, 2015

(86) PCT No.: PCT/CN2015/085674
§ 371 (c)(1),
(2) Date: Feb. 17, 2017

(87) PCT Pub. No.: WO2016/026378
PCT Pub. Date: Feb. 25, 2016

(65) Prior Publication Data

US 2017/0260769 A1 Sep. 14, 2017

(30) Foreign Application Priority Data

Aug. 18, 2014 (CN) ..... 2014 1 0407885

(51) Int. Cl.
*F16D 31/02* (2006.01)
*E04H 12/34* (2006.01)
(Continued)

(52) U.S. Cl.
CPC ..... *E04H 12/345* (2013.01); *E21B 7/023* (2013.01); *E21B 15/00* (2013.01); *F15B 11/046* (2013.01);
(Continued)

(58) Field of Classification Search
CPC . F15B 11/0413; F15B 11/042; F15B 11/0423; F15B 11/044; F15B 11/0445; F15B 11/046
See application file for complete search history.

(56) References Cited

U.S. PATENT DOCUMENTS 2,904,310 A * 9/1959 Leonard ..... E21B 7/023 173/159
4,403,897 A * 9/1983 Willis ..... E21B 19/155 269/238
(Continued)

FOREIGN PATENT DOCUMENTS

CN 2923608 Y 7/2007
CN 203547701 U 4/2014
(Continued)

OTHER PUBLICATIONS

International Search Report for International Application No. PCT/CN2015/085674 dated Nov. 6, 2015.

*Primary Examiner* — Michael Leslie
(74) *Attorney, Agent, or Firm* — Carter, DeLuca & Farrell LLP

(57) ABSTRACT

Disclosed is a tower lifting device for a rotary blasthole drill, comprising a hydraulic cylinder (5), an extending oil path (7), a retracting oil path (6), a speed control oil path (14) and a proximity switch (3), wherein the extending oil path (7) is connected to a non-rod-end chamber of the hydraulic cylinder (5), and an extension control unit is provided on the extending oil path (7); the retracting oil path (6) is connected to a rod-end chamber of the hydraulic cylinder (5), and a
(Continued)

retraction control unit is provided on the retracting oil path (6); the speed control oil path (14) is connected to the retracting oil path (6), the speed control oil path (14) is connected to a speed control valve block (15) in series and the tail end thereof is connected to an oil tank (16); the proximity switch (3) is arranged on a tower supporting frame (2) for controlling the switching on and off of the speed control valve block (15), and when the tower (4) is approximately in a horizontal state, the speed control valve block (15) is on. By using such a tower lifting device in the present invention, the speed at which the tower is laid down to a horizontal state can be conveniently controlled.

5 Claims, 3 Drawing Sheets

(51) Int. Cl.

| | |
|---|---|
| ***F15B 11/046*** | (2006.01) |
| ***F15B 11/042*** | (2006.01) |
| ***F15B 11/04*** | (2006.01) |
| ***F15B 11/044*** | (2006.01) |
| ***E21B 15/00*** | (2006.01) |
| ***E21B 7/02*** | (2006.01) |

(52) U.S. Cl.
CPC ..... *F15B 11/0413* (2013.01); *F15B 11/0423* (2013.01); *F15B 11/0445* (2013.01)

(56) References Cited

U.S. PATENT DOCUMENTS

| | | | | |
|---|---|---|---|---|
| 4,503,917 | A * | 3/1985 | Hargenrader | E21B 19/084 173/147 |
| 6,230,606 | B1 * | 5/2001 | Sato | F15B 11/044 251/129.06 |
| 6,715,402 | B2 * | 4/2004 | Pfaff | F15B 11/006 91/526 |
| 6,837,045 | B2 * | 1/2005 | Heusser | F15B 11/003 60/403 |
| 2011/0072737 | A1 | 3/2011 | Wasterval | |

FOREIGN PATENT DOCUMENTS

| | | | |
|---|---|---|---|
| CN | 104179460 | A | 12/2014 |
| CN | 204002591 | U | 12/2014 |
| JP | H06346677 | A | 12/1994 |

* cited by examiner

TOWER LIFTING DEVICE FOR ROTARY BLASTHOLE DRILL

TECHNICAL FIELD

The present invention relates to the field of rotary blasthole drills, and more particularly, to a tower lifting device for a rotary blasthole drill.

BACKGROUND

A rotary blasthole drill is drilling equipment in construction, generally used in a large-scale surface mine. When the rotary blasthole drill is working, a tower needs to be in a vertical state, and when the rotary blasthole drill is travelling, the tower should be laid down on a tower supporting frame, that is, in a horizontal state. Typically switching between the vertical state and the horizontal state of the tower is performed by a hydraulic cylinder.

In the prior art, the tower is connected to a main frame through two hydraulic cylinders, and the horizontal and vertical states of the tower are controlled by the extension and retraction of a piston rod in the hydraulic cylinder. When the piston rod of the hydraulic cylinder fully extends out, the tower is in the vertical state; when the piston rod of the hydraulic cylinder fully retracts, the tower is in the horizontal state. In particular, when oil enters into the rod-end chamber of the cylinder, the piston rod of the hydraulic cylinder begins to retract, and the tower begins to be laid down; on the contrary, when the piston rod of the hydraulic cylinder extends out, the tower begins to erect gradually.

In such a conventional manner, the speed at which the tower is laid down (horizontal state) and erects (vertical state) is controlled by adjusting the oil intake amount of the hydraulic cylinder. Since it is necessary to improve working efficiency, the tower is usually laid down at a relatively fast speed, and in this way, a large impact will act on the tower when the tower is laid down. If the oil intake amount of the oil tank is reduced, the impact on the tower can be reduced, however, this will reduce working efficiency.

In order to solve the above-mentioned problems, it is generally carried out by changing the material or reducing the oil intake amount of the hydraulic cylinder in the prior art, which results in the increase of the cost or decrease of the working efficiency of the drill.

SUMMARY OF THE INVENTION

The present invention provides a tower lifting device for a rotary blasthole drill, which is able to solve the problem of a large impact acting on a tower when the tower is laid down in the conventional tower lifting device.

In order to solve the above-mentioned problems, the present invention provides a tower lifting device for a rotary blasthole drill, the rotary blasthole drill comprising a main frame and a tower, a tower supporting frame and the tower lifting device for controlling the tower to switch between a vertical state and a horizontal state are arranged between the main frame and the tower, wherein, the tower lifting device comprises a hydraulic cylinder, an extending oil path, a retracting oil path, a speed control oil path and a proximity switch, the extending oil path is connected to a non-rod-end chamber of the hydraulic cylinder, and an extension control unit is provided on the extending oil path;

the retracting oil path is connected to a rod-end chamber of the hydraulic cylinder, and a retraction control unit is provided on the retracting oil path;

the speed control oil path is connected to the retracting oil path, and the speed control oil path is connected with a solenoid directional control valve and a one-way throttle valve in series, wherein the tail end of the speed control oil path is connected to the oil tank; and the proximity switch is arranged on the tower supporting frame and used for controlling the switching on and off of the solenoid directional control valve, and when the tower is approximately in the horizontal state, the solenoid directional control valve is on.

Preferably, the one-way throttle valve is an adjustable one-way throttle valve.

Preferably, the number of the hydraulic cylinders is two, the extending oil path includes an extending main oil path, a first extending branch and a second extending branch, one end of the first extending branch and one end the second extending branch are each connected to the extension main oil path, while the other end of the first extending branch and the other end of the second extending branch are connected to the non-rod-end chamber of the corresponding hydraulic cylinder respectively, and the first extending branch and the second extending branch are each connected in series with the extension control unit; and the retracting oil path includes a retracting main oil path, a first retracting branch and a second retracting branch, the speed control oil path is connected to the retracting main oil path, one end of the first retracting branch and one end of the second retracting branch are connected to the retracting main oil path, while the other end of the first retracting branch and the other end of the second retracting branch are connected to the rod-end chamber of the corresponding hydraulic cylinder respectively, the first retracting branch and the second retracting branch are each connected in series with the retraction control unit.

Preferably the extension control unit is a hydraulic control one-way sequence valve, wherein the one located on the first extending branch is a first hydraulic control one-way sequence valve, and the one located on the second extending branch is a second hydraulic control one-way sequence valve, wherein, the first hydraulic control one-way sequence valve and the second hydraulic control one-way sequence valve are arranged so that the oil outlets thereof are adjacent to each other;

the retraction control unit is a hydraulic control one-way sequence valve, wherein the one located on the first retracting branch is a third hydraulic control one-way sequence valve, and the one located on the second retracting branch is a fourth hydraulic control one-way sequence valve, wherein, the third hydraulic control one-way sequence valve and the fourth hydraulic control one-way sequence valve are arranged so that the oil outlets thereof are adjacent to each other; and a control oil port of the first hydraulic control one-way sequence valve is connected to the oil outlet of the third hydraulic control one-way sequence valve, a control oil port of the second hydraulic control one-way sequence valve is connected to the oil outlet of the fourth hydraulic control one-way sequence valve, a control oil port of the third hydraulic control one-way sequence valve is connected to the oil outlet of the first hydraulic control one-way sequence valve, and a control oil port of the fourth hydraulic control one-way sequence valve is connected to the oil outlet of the second hydraulic control one-way sequence valve.

Preferably, a first one-way throttle valve is connected in series with the first extending branch at the position between the first hydraulic control one-way sequence valve and the hydraulic cylinder, the direction of the first one-way throttle valve being coincident with the direction of the first hydraulic control one-way sequence valve; and a second one-way throttle valve is connected in series with the second extending branch at the position between the second hydraulic control one-way sequence valve and the hydraulic cylinder, the direction of the second one-way throttle valve being coincident with the direction of the second hydraulic control one-way sequence valve.

In the tower lifting device for the rotary blasthole drill of the present invention, a proximity switch is provided on the tower supporting frame, and the proximity switch is used for controlling the switching on and off of the solenoid directional control valve so as to decrease the speed of the tower when the tower is to be in a horizontal state. In the device of the present invention, when the tower approaches the tower supporting frame, the proximity switch controls the solenoid directional control valve to be in the ON state, and at this point, part of the oil flows back to the oil tank through the speed control oil path, and because oil in the rod-end chamber of the hydraulic cylinder is reduced, the speed at which the piston rod in the hydraulic cylinder moves is also decreased, thus, the impact on the tower can be effectively reduced.

DETAILED DESCRIPTION

Hereinafter, the structure and working principles of the present invention will be described in further detail with reference to the accompanying drawings.

Figure 1:
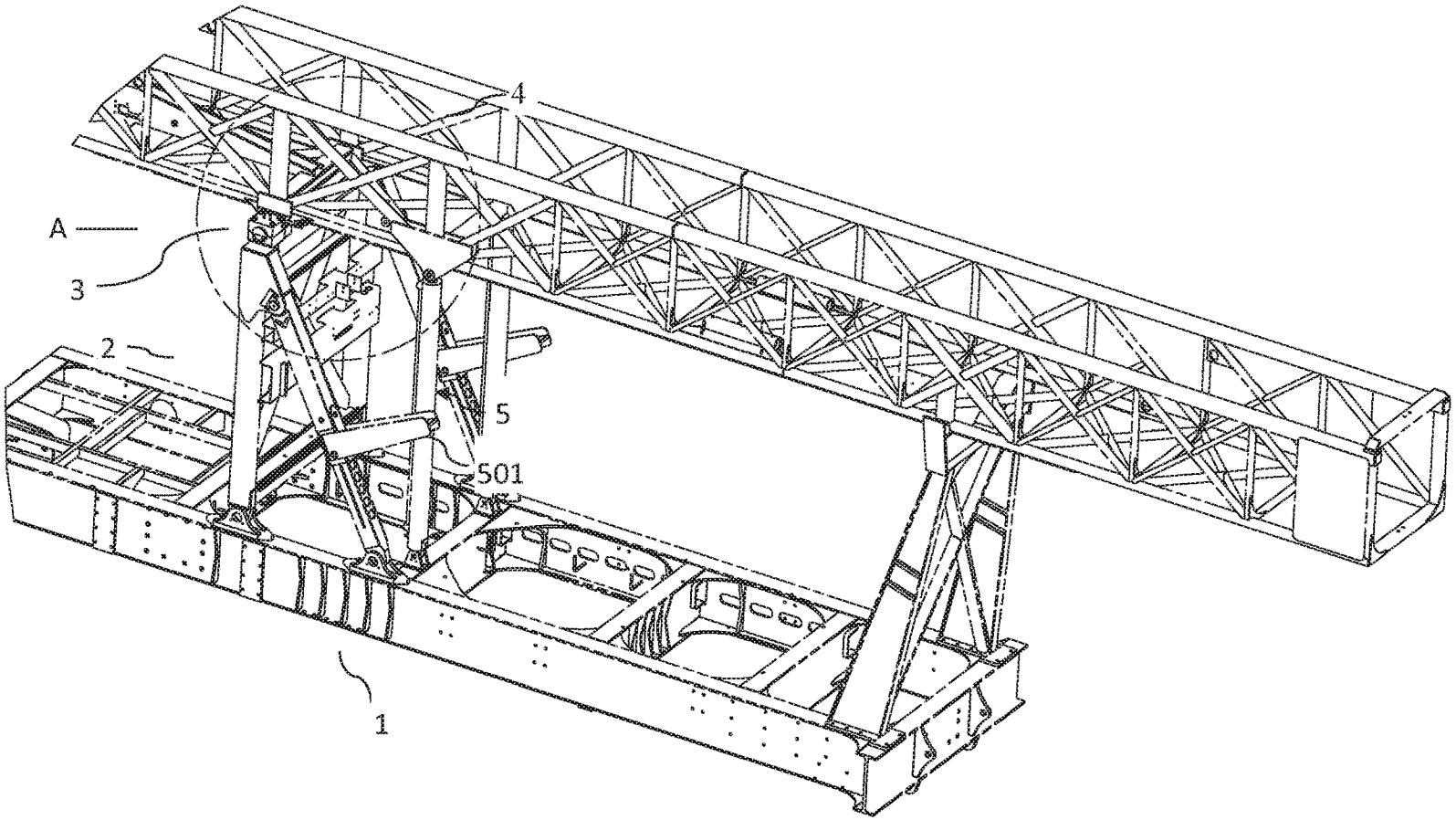
FIG. 1 is a schematic structural view of a tower lifting device for a rotary blasthole drill showing the mounting position of a proximity switch according to the present invention.
Figure 2:
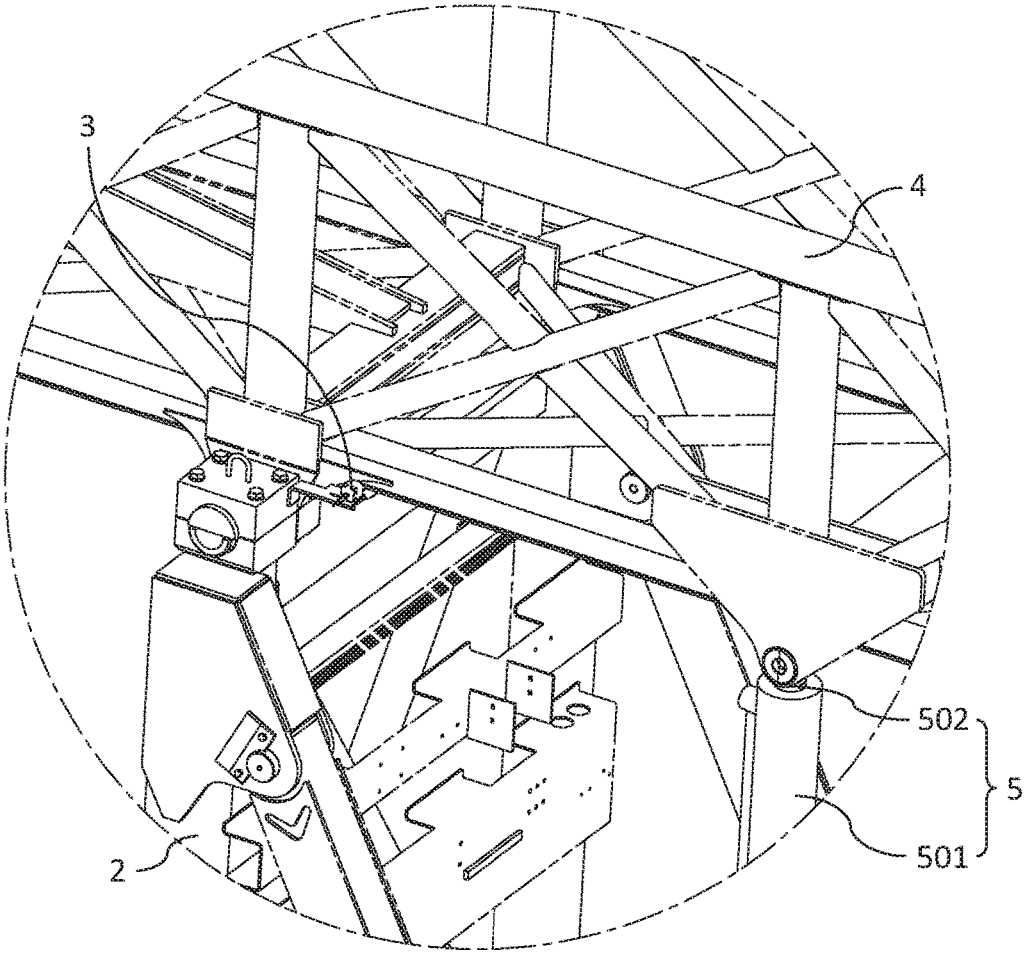
FIG. 2 is a partially enlarged view of part A of FIG. 1.

FIGS. 1 to 2 show a structural schematic view of a tower lifting device for a rotary blasthole drill, mainly showing the general mounting position of the proximity switch 3 in the present invention.

With reference to FIGS. 1 to 2, the rotary blasthole drill includes a main frame 1 and a tower 4. The main frame 1 is located below the tower 4, constructing the main support of the rotary blasthole drill. Between the main frame 1 and the tower 4, a tower supporting frame 2 and a tower lifting device for controlling the tower 4 to switch between a vertical state and a horizontal state are provided. One end of the tower supporting frame 2 is hinged with the main frame 1, and the other end thereof is hinged with the tower 4, wherein the tower lifting device includes a hydraulic cylinder 5 and the like.

Figure 3:
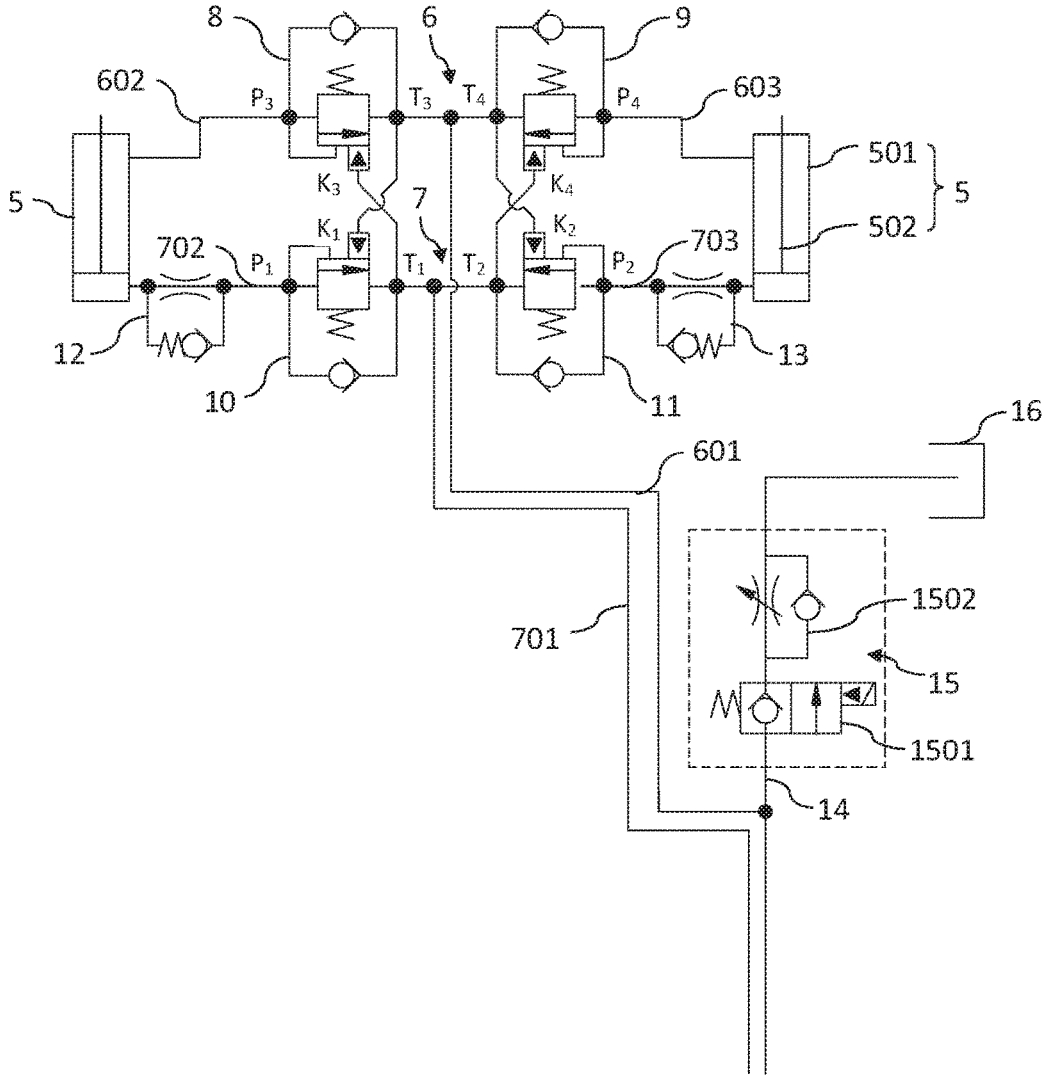
FIG. 3 is a schematic diagram of the hydraulic principle of the tower lifting device for the rotary blasthole drill according to the present invention.

FIG. 3 is a schematic diagram of the hydraulic principle of the tower lifting device for the rotary blasthole drill according to the present invention, specifically showing the connecting relation of each hydraulic component.

Referring to FIG. 3 and in conjunction with FIGS. 1 and 2, more particularly, the tower lifting device of the present invention includes a hydraulic cylinder 5, an extending oil path 7, a retracting oil path 6, a speed control oil path 14 and a proximity switch 3. Hereinafter, each of them will be explained respectively.

The extending oil path 7 is connected to the non-rod-end chamber of the hydraulic cylinder 5, and an extension control unit is provided on the extending oil path 7, wherein the extension control unit is used for controlling the oil pressure of a non-rod-end chamber and the like, in order to ensure the stability of the tower 4 at the time when the piston rod 502 extends out (for achieving the vertical state of the tower 4).

The retracting oil path 6 is connected to the rod-end chamber of the hydraulic cylinder 5, and a retraction control unit is provided on the retracting oil path 6. Similarly, the retraction control unit is used for controlling the oil pressure of a rod-end chamber and the like, in order to ensure the stability of the tower 4 at the time when the piston rod 502 retracts (for achieving the horizontal state of the tower 4).

Since the speed at which the tower 4 is laid down is relatively fast, a relatively large impact will act on the tower 4. Therefore, in order to avoid this problem, a speed control oil path 14 is additionally provided in the present invention. The speed control oil path 14 is connected to the retracting oil path 6, and a speed control valve block 15 is connected to the speed control oil path 14 in series, wherein the speed control valve block 15 includes a solenoid directional control valve 1501 and a one-way throttle valve 1502 connected in series, and the tail end of the speed control oil path 14 is connected to the oil tank 16. The switching on off of the solenoid directional control valve 1501 is controlled by the proximity switch 3, and as shown in FIGS. 1 and 2, the proximity switch 3 is provided on the tower supporting frame 2. When the tower 4 is approximately in the horizontal state, the proximity switch 3 senses the position of the tower 4, thereby energizing the coil thereof, the auxiliary contact operates, and the coil controlling the solenoid directional control valve 1501 operates, so that the solenoid directional control valve 1501 is switched on, while at this time, the speed control oil path 14 is got through, and part of the oil can return to the oil tank 16 through the speed control oil path 14, thus the oil entering into the rod-end chamber of the hydraulic cylinder 5 is reduced, thereby reducing the lowering speed of the tower 4 and reducing the impact on the tower 4.

The speed control valve block 15 is mainly used for realizing the on-off control of the speed control oil path 14, and it is also possible to realize the flow volume and the flow rate control of the oil in the speed control oil path 14, thereby controlling the speed at which the tower 4 is laid down. As shown in the drawing, the speed control valve block 15 includes a solenoid directional control valve 1501 and a one-way throttle valve 1502 connected in series with the solenoid directional control valve 1501. The solenoid directional control valve 1501 has a first working position at which an oil inlet and an oil outlet are connected and a second working position at which the oil inlet and the oil outlet are disconnected. The proximity switch 3 controls the switching of the working positions of the solenoid directional control valve 1501, thereby controlling the on-off of the speed control oil path 14. In particular, the second working position of the solenoid directional control valve 1501 may be achieved by the one-way valve shown in the drawing, that is, the one-way valve can prevent the oil from flowing to the oil tank 16. The one-way throttle valve 1502 is composed of a throttle valve and a one-way valve connected in parallel thereto.

Further, the one-way throttle valve on the speed control oil path 14 may be selected as an adjustable one-way throttle valve for flow volume adjustment.

The lifting control of the tower 4 can be implemented in a variety of modes. Next, one of the modes will be described with reference to FIG. 3, and this, of course, does not constitute to the only limitation to the specific structure of the present invention.

As shown in FIG. 1, the number of the hydraulic cylinders 5 is two. The cylinder body 501 of the hydraulic cylinder 5 is hinged to the upper side of the main frame 1, and the piston rod 502 of the hydraulic cylinder 5 is hinged to the tower 4.

With continued reference to FIG. 3, the extending oil path 7 includes an extending main oil path 701, a first extending branch 702, and a second extending branch 703. One end of the first extending branch 702 and one end of the second extending branch 703 are each connected to the extending main oil path 701, for example, via a tee joint, while the other end of the first extending branch 702 and the other end of the second extending branch 703 are connected to the non-rod-end chamber of the respective hydraulic cylinder 5 respectively. The first extending branch 702 and the second extending branch 703 are each connected in series with an extension control unit.

The extension control unit may be selected as a hydraulic control one-way sequence valve. Specifically, the one located on the first extending branch 702 is a first hydraulic control one-way sequence valve 10, and the one located on the second extending branch 703 is a second hydraulic control one-way sequence valve 11. The oil inlet P1 of the first hydraulic control one-way sequence valve 10 is connected to the non-rod-end chamber of the hydraulic cylinder on the left side in the drawing, and the oil outlet T1 is connected to the extending main oil path 701. The oil inlet P2 of the second hydraulic control one-way sequence valve 11 is connected to the non-rod-end chamber of the hydraulic cylinder on the right side in the drawing, and the oil outlet T2 is connected to the extending main oil path 701. That is, the first hydraulic control one-way sequence valve 10 and the second hydraulic control one-way sequence valve 11 are arranged so that the oil outlets T1 and T2 thereof are adjacent to each other.

The retracting oil path 6 includes a retracting main oil path 601, a first retracting branch 602 and a second retracting branch 603. The speed control oil path 14 is connected to the retracting main oil path 601, and one end of the first retracting branch 602 and one end of the second retracting branch 603 are each connected to the retracting main oil path 601, while the other end of the first retracting branch 602 and the other end of the second retracting branch 603 are connected to the rod-end chamber of the respective hydraulic cylinder 5 respectively. The first retracting branch 602 and the second retracting branch 603 are connected in series with a retraction control unit respectively.

The retraction control unit may also be selected as a hydraulic control one-way sequence valve. In particular, the one located on the first retracting branch 602 is a third hydraulic control one-way sequence valve 8, and the one located on the second retracting branch 603 is a fourth hydraulic control one-way sequence valve 9. The oil inlet P3 of the third hydraulic control one-way sequence valve 8 is connected to the rod-end chamber of the hydraulic cylinder on the left side in the drawing, and the oil outlet T3 is connected to the retracting main oil path 601. The oil inlet P4 of the fourth hydraulic control one-way sequence valve 9 is connected to the rod-end chamber of the hydraulic cylinder on the right side in the drawing, and the oil outlet T4 is connected to the retracting main oil path 601. That is, the third hydraulic control one-way sequence valve 8 and the fourth hydraulic control one-way sequence valve 9 are arranged so that the corresponding oil outlets T3 and T4 thereof are adjacent to each other.

The aforementioned four hydraulic control one-way sequence valves have the following relationship: a control oil port K1 of the first hydraulic control one-way sequence valve 10 is connected to the oil outlet T3 of the third hydraulic control one-way sequence valve 8, and a control oil port K2 of the second hydraulic control one-way sequence valve 11 is connected to the oil outlet T4 of the fourth hydraulic control one-way sequence valve 9, while a control oil port K3 of the third hydraulic control one-way sequence valve 8 is connected to the oil outlet T1 of the first hydraulic control one-way sequence valve 10, and a control oil port K4 of the fourth hydraulic control one-way sequence valve 9 is connected to the oil outlet T2 of the second hydraulic control one-way sequence valve.

In order to adjust the speed at which the tower 4 is laid down, a first one-way throttle valve 12 is connected in series with the first extending branch 702 at the position between the first hydraulic control one-way sequence valve 10 and the hydraulic cylinder 5, and the direction of the first one-way throttle valve 12 coincides with the direction of the first hydraulic control one-way sequence valve 10, that is, it is in working (throttling) state when the non-rod-end chamber outputs oil.

Similarly, a second one-way throttle valve 13 is connected in series with the second extending branch 703 at the position between the second hydraulic control one-way sequence valve 11 and the hydraulic cylinder 5, and the direction of the second one-way throttle valve 13 coincides with the direction of the second hydraulic control one-way sequence valve 11, that is, it is in working (throttling) state when the non-rod-end chamber outputs oil.

The description above is only illustrative description of the present invention. Thus, it will be appreciated by those skilled in the art that various modifications can be made to the present invention without departing from the working principles of the present invention, and these modifications fall within the scope of the present invention.

The invention claimed is:

1. A tower lifting device for a rotary blasthole drill, the rotary blasthole drill comprising a main frame and a tower, wherein a tower supporting frame and the tower lifting device for controlling the tower to switch between a vertical state and a horizontal state are arranged between the main frame and the tower, characterized in that, the tower lifting device comprises a hydraulic cylinder, an extending oil path, a retracting oil path, a speed control oil path and a proximity switch, wherein, the extending oil path is connected to a non-rod-end chamber of the hydraulic cylinder, and an extension control unit is provided on the extending oil path;

the retracting oil path is connected to a rod-end chamber of the hydraulic cylinder, and a retraction control unit is provided on the retracting oil path;

the speed control oil path is connected to the retracting oil path, and the speed control oil path is connected with a solenoid directional control valve and a one-way throttle valve in series, wherein the tail end of the speed control oil path is connected to an oil tank; and the proximity switch is arranged on the tower supporting frame and used for controlling the switching on and off of the solenoid directional control valve, and when the tower is approximately in the horizontal state, the solenoid directional control valve is on.

2. The tower lifting device for a rotary blasthole drill according to claim 1, characterized in that, the one-way throttle valve is an adjustable one-way throttle valve.

3. The tower lifting device for a rotary blasthole drill according to claim 1, characterized in that, the number of the hydraulic cylinders is two, wherein, the extending oil path includes an extending main oil path, a first extending branch and a second extending branch, one end of the first extending branch and one end of the second extending branch are each connected to the extension main oil path, while the other end of the first extending branch and the other end of the second extending branch are connected to the non-rod-end chamber of the corresponding hydraulic cylinder respectively, and the first extending branch and the second extending branch are each connected in series with the extension control unit; and the retracting oil path includes a retracting main oil path, a first retracting branch and a second retracting branch, the speed control oil path is connected to the retracting main oil path, one end of the first retracting branch and one end of the second retracting branch are connected to the retracting main oil path, while the other end of the first retracting branch and the other end of the second retracting branch are connected to the rod-end chamber of the corresponding hydraulic cylinder respectively, and the first retracting branch and the second retracting branch are each connected in series with the retraction control unit.

4. The tower lifting device for a rotary blasthole drill according to claim 3, characterized in that, the extension control unit is a hydraulic control one-way sequence valve, the one located on the first extending branch being a first hydraulic control one-way sequence valve, the one located on the second extending branch being a second hydraulic control one-way sequence valve, wherein, the first hydraulic control one-way sequence valve and the second hydraulic control one-way sequence valve are arranged so that the oil outlets thereof are adjacent to each other;

the retraction control unit is a hydraulic control one-way sequence valve, the one located on the first retracting branch being a third hydraulic control one-way sequence valve, the one located on the second retracting branch being a fourth hydraulic control one-way sequence valve, wherein, the third hydraulic control one-way sequence valve and the fourth hydraulic control one-way sequence valve are arranged so that the oil outlets thereof are adjacent to each other; and a control oil port of the first hydraulic control one-way sequence valve is connected to the oil outlet of the third hydraulic control one-way sequence valve, a control oil port of the second hydraulic control one-way sequence valve is connected to the oil outlet of the fourth hydraulic control one-way sequence valve, a control oil port of the third hydraulic control one-way sequence valve is connected to the oil outlet of the first hydraulic control one-way sequence valve, and a control oil port of the fourth hydraulic control one-way sequence valve is connected to the oil outlet of the second hydraulic control one-way sequence valve.

5. The tower lifting device for a rotary blasthole drill according to claim 4, characterized in that, a first one-way throttle valve is connected in series with the first extending branch at the position between the first hydraulic control one-way sequence valve and the hydraulic cylinder, the direction of the first one-way throttle valve being coincident with the direction of the first hydraulic control one-way sequence valve; and a second one-way throttle valve is connected in series with the second extending branch at the position between the second hydraulic control one-way sequence valve and the hydraulic cylinder, the direction of the second one-way throttle valve being coincident with the direction of the second hydraulic control one-way sequence valve.

* * * * *